US005474016A

United States Patent [19]

Haney

[11] Patent Number: 5,474,016

[45] Date of Patent: Dec. 12, 1995

[54] OVERHEAD BARRIER WARNING SYSTEM FOR TRUCKS OR BUSES

[76] Inventor: William J. Haney, 27 Pickwick Dr., Commack, N.Y. 11725

[21] Appl. No.: 251,300

[22] Filed: May 31, 1994

[51] Int. Cl.[6] ..... E01F 9/00

[52] U.S. Cl. ..... 116/28 R; 116/63 R

[58] Field of Search ..... 116/63 P, 63 R, 116/28 R, 203, 209, DIG. 16, 205, 67 R, 169, 141; 40/606, 607, 608, 612, 617; 404/9–11; 52/40, 174; 248/415, 417, 548, 900; 246/473 R, 473.1, 486

[56] References Cited

U.S. PATENT DOCUMENTS

| | | | |
|---|---|---|---|
| 770,036 | 9/1904 | Allen | 246/486 |
| 965,566 | 7/1910 | Cooley | 40/607 |
| 1,360,992 | 11/1920 | Strimple | 246/486 |
| 1,454,753 | 5/1923 | McGhee | 116/28 R |
| 1,669,695 | 5/1928 | Devereux | 116/28 R |
| 1,808,692 | 6/1931 | Sudduth | 40/606 |
| 2,409,076 | 10/1946 | Steinberger et al. | 116/173 |
| 3,612,460 | 10/1971 | Smith | 40/607 |
| 4,346,666 | 8/1982 | Iso | 116/63 R |
| 4,490,917 | 1/1985 | Pilling | 116/28 R |

*Primary Examiner*—William A. Cuchlinski, Jr.
*Assistant Examiner*—Andrew Hirshfeld
*Attorney, Agent, or Firm*—Galgano & Burke

[57] ABSTRACT

An overhead clearance warning includes an over the road horizontal member with several spaced apart depending chains carrying cylinders. The cylinders are preferably hollow plastic or aluminum and are provided with reflective stripes. The chains and cylinders are arranged so that the distance from the road surface to the bottoms of the cylinders is substantially the same as or slightly less than the overhead clearance of which the system is warning. When a vehicle which is taller than the overhead clearance approaches the warning system, the reflective stripes on the cylinders provide a visual warning of the low clearance condition. If the visual warning is ignored, the tall vehicle will strike the hollow cylinders and a relatively loud audible warning will result without damaging the vehicle. The preferred embodiment of the invention provides both alphanumeric and iconic warning signs which are mounted at locations where they are easy to see, are protected from elements and vandalism, and require little or no maintenance. The invention may be mounted on existing roadside lamp posts or may be mounted on its own post or posts. Several different embodiments of mounting the system are disclosed. In one embodiment, the warning system is mounted for rotation about a vertical post and includes frangible links to prevent serious damage to a tall vehicle which strikes the warning device. In another embodiment, the system is mounted on a wall over a garage or tunnel entrance as a fail safe final warning.

13 Claims, 8 Drawing Sheets

OVERHEAD BARRIER WARNING SYSTEM FOR TRUCKS OR BUSES

BACKGROUND OF THE INVENTION

1. Field of the Invention

The invention relates to an overhead barrier warning system. More particularly, the invention relates to a visual and audible vehicular overhead clearance warning system to warn and deter tall vehicle operators not to enter or travel on restricted roadways that have low overhead clearance bridges.

2. Prior Art

Insufficient overhead clearance for tall vehicles is a well known traffic control problem. Every year, many lives are lost in accidents caused by tall trucks and buses attempting to pass under a low bridge or overpass. Even in cases where the accidents do not result in personal injuries, they always result in large traffic delays. These delays increase fuel consumption and air pollution and waste many hours for commuters. Substantial governmental resources are expended in removing tall vehicles which are stuck under a low bridge or overpass. The bridge or overpass is often damaged and requires repair. In any event it must be inspected for safety. The tall vehicle is always severely damaged, sometimes irreparably and it is thus taken out of service resulting in economic loss to many parties. Delivery of cargo carried by the tall vehicle is delayed and sometimes the cargo is damaged or destroyed.

It is common practice today to place highway overhead clearance signs on vertical posts imbedded in the ground on the shoulders of roadways before low bridges or at intersections where roadways lead to low clearance bridges. In rare instances overhead clearance signs are displayed over the roadway but they are the exception.

Signs that are posted to warn tall vehicles of the height clearance of a bridge ahead, can, at certain times, be difficult to see and/or interpret. Overhead clearance signs on vertical posts for eye level viewing suffer from a number of disadvantages. In northern climates ice, snow, rain, and fog often reduce a driver's visibility and consequently informational signs on vertical posts at eye level often times lose their effectiveness. Poor and infrequent maintenance of highway informational overhead clearance signs on vertical posts allows the words and numbers to weather and as a result the message displayed can become difficult to read or interpret. The overgrowth of vegetation near highway clearance signs mounted on vertical posts often covers or obscures the warning message displayed. At times these important overhead clearance warning signs that are mounted on vertical posts get knocked down and immediate replacement is not always accomplished. A common form of mischief that takes place today is the rampant and uncontrolled graffiti writing that is applied to highway informational signs used to warn motorists of highway hazards such as low bridges or to warn commercial traffic to stay off certain roadways or parkways with extremely low bridges. Informational signs damaged by graffiti are difficult or impossible to read.

Traffic informational clearance signs mounted on posts are usually placed before or at an intersection to alert truck or bus drivers of the maximum overhead clearance on the roadway ahead. In heavy traffic conditions a driver's view of an eye level warning clearance sign can easily be obstructed by other vehicles and therefore a tall vehicle can inadvertently enter a restricted roadway meant only for passenger cars. Operators of tall motor vehicles on a roadway without adequate overhead clearance warning signs are vulnerable and might impact a low bridge ahead.

The use of overhead chains suspended from a horizontal member mounted on a vertical pole above a roadway without accompanying informational signs does not adequately deal with the prevention or deterrence of tall motor vehicles from entering restricted roadways. These chains do not present a highly visible warning to the operators of tall vehicles. A vehicle which impacts a suspended chain will not necessarily make enough noise to alert the driver to the dangerous condition of a low bridge ahead.

U.S. Pat. No. 4,346,666 to Iso discloses a console traffic direction post which includes a horizontal arm carrier on a vertical support member and a reflector suspended from the horizontal arm carrier. The direction post is less subject to occlusion by snow in the winter, is less likely to be damaged, and is inexpensive to maintain. It does not, however, address the particular problems associated with overhead clearance warnings.

U.S. Pat. No. 3,631,619 to Campbell discloses an overhead traffic informational or directional sign which is suspended from the roof of a tunnel and is elongated in the direction of the movement of the traffic resulting in a condition called anamorphosis. This results in a sign which is less likely to be obscured by other vehicles. It is inapplicable as an overhead clearance warning, however.

SUMMARY OF THE INVENTION

It is therefore an object of the invention to provide a highly visible and audible overhead clearance warning system designed for tall vehicles which is easy to construct and install, is durable and requires little or no maintenance.

It is a further object of the invention to provide an overhead clearance warning apparatus which is more effective than present traffic informational warning signs as they are now used.

It is another object of the invention to provide a warning device for operators of tall vehicles that is not affected by weather such as rain, snow, ice storms and fog or by the overgrowth of roadside foliage.

It is still another object of the invention to provide a warning device where the upper portion of the warning system is not easily removed or covered with graffiti.

It is also an object of the invention to provide a warning device which will not cause serious damage to a tall vehicle if it is struck by a tall vehicle.

It is still a further objection of the invention to provide a final warning for operators of tall vehicles by strategically positioning the warning system in a place that serves as a "fail safe" device if all other warning indicators have not been observed.

In accord with these objects, which will be discussed in detail below, the warning system of the present invention includes an over the road horizontal member with several spaced apart depending chains carrying cylinders. The cylinders are preferably hollow plastic or aluminum and are provided with reflective stripes. The chains and cylinders are arranged so that the distance from the road surface to the bottoms of the cylinders is substantially the same as or slightly less than the overhead clearance of which the system is warning. When a vehicle which is taller than the overhead clearance approaches the warning system, the reflective stripes on the cylinders provide a visual warning of the low clearance condition. If the visual warning is ignored, the tall vehicle will strike the hollow plastic or aluminum cylinders and a relatively loud audible warning will result without damaging the tall vehicle. The invention may be used together with conventional clearance warning signs. However, the preferred embodiment of the invention provides both alphanumeric and iconic warning signs which are mounted at locations where they are easy to see, are protected from elements and vandalism, and require little or no maintenance. The invention may be mounted on existing roadside lamp posts or may be mounted on its own post or posts. Several different embodiments of mounting the system are disclosed. In one embodiment, the warning system is mounted for rotation about a vertical post and includes frangible links to prevent serious damage to a tall vehicle which strikes the warning device. In another embodiment, the system is mounted on a wall over a garage or tunnel entrance as a fail safe final warning.

The warning system according to the invention is free from interference by weather, foliage, and vandals because of its relatively high location over the roadway. The simplicity of the invention makes it easy and inexpensive to manufacture and install. Both the simplicity and the location make the warning system virtually maintenance free.

Additional objects and advantages of the invention will become apparent to those skilled in the art upon reference to the detailed description taken in conjunction with the provided figures.

DETAILED DESCRIPTION OF THE PREFERRED EMBODIMENTS

Figure 1:
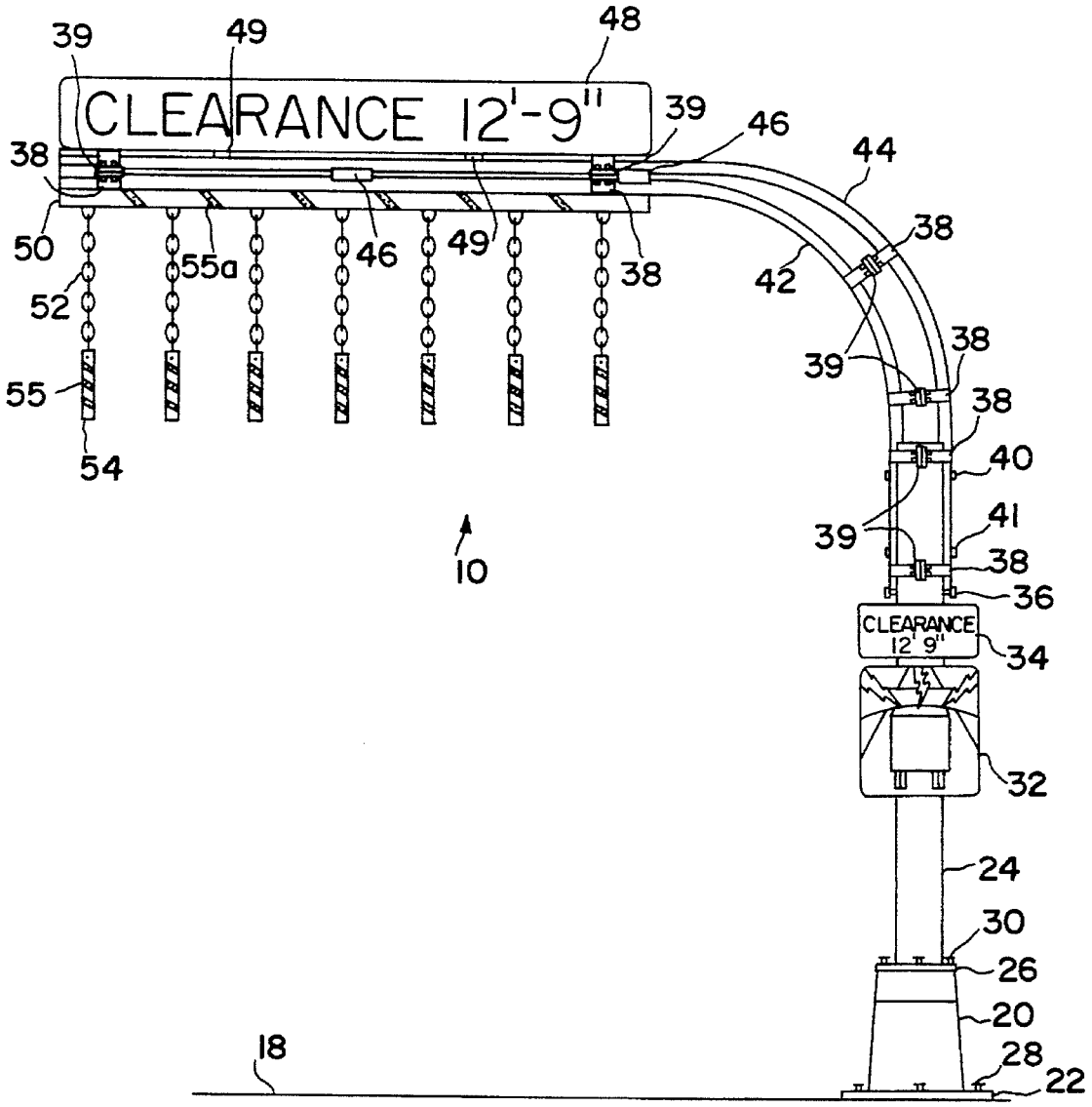
FIG. 1 is a side elevation view of a first embodiment of the overhead warning system according to the invention.

Turning now to FIGS. 1 through 4, a first embodiment of the overhead warning system 10 according to the invention is mounted on a standard highway light pole 24 which is adapted and used as a means of support. Vertical pole 24 is typically mounted on base 20 by means of a connector flange 26, and pole flange connector bolts 30. Base 20 is typically mounted to a concrete base with connector flange 22 and base flange bolts 28. As seen best in FIG. 2A, the cross section of the vertical pole 24 is generally elliptical with two semi-circular grooves 37L, 37R. According to this embodiment of the invention, an upper horizontal arm 44 and a lower horizontal arm 42 are affixed to vertical member or pole 24 with support bands 38 and clamps 39. The arms 42, 44 are preferably cylindrical and fit comfortably in the grooves 37L, 37R as seen best in FIG. 2B. Fastening clamps 39 hold the upper horizontal arm 44 and lower horizontal arm 42 in place on vertical pole 24. Clamp connectors 39 lock the locking bands 38 around horizontal arms 42 and 44. A horizontal support arms stop bolt 36 is mounted in the pole 24 and prevents arms 42 and 44 from sliding downward on pole 24. An upper shear pin 40 and lower shear pin 41 are mounted in the pole 24 and the arms 42, 44 and will shear off if cylindrical horizontal arms 42 and 44 are rotated in the grooves 37L, 37R due to accidental impact by a tall vehicle. Although pins 40 and 41 are made to shear, they also add support and stability to horizontal arms 42 and 44. The horizontal arm support bands 38 allow cylindrical arms 42 and 44 to rotate on the vertical pole 24 where they encompass the pole 24 near the shear pins 40 and 41.

Figure 2:
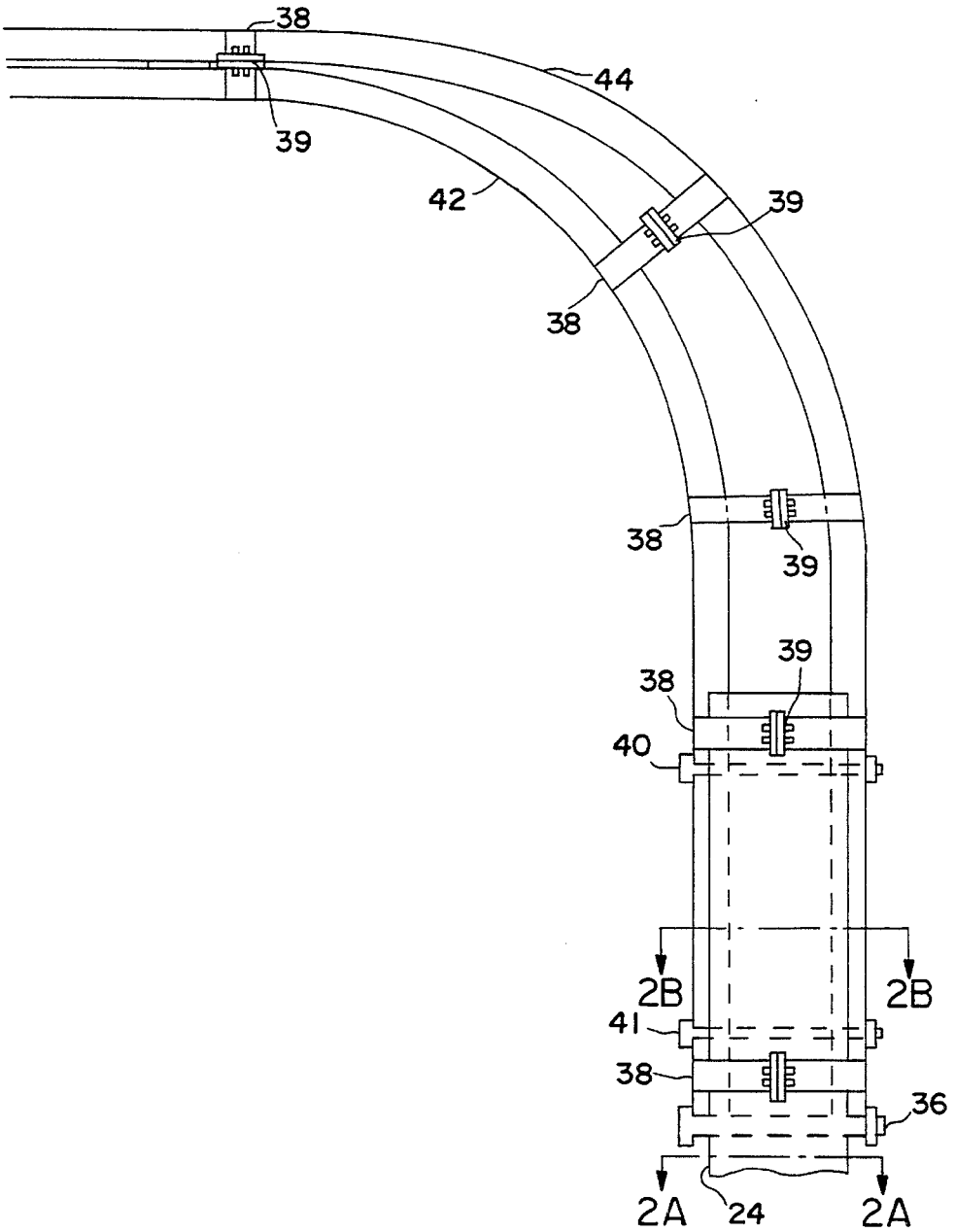
FIG. 2 is an enlarged portion of the embodiment of FIG. 1 showing the vertical support pole and the horizontal arm connection.
Figure 2A:
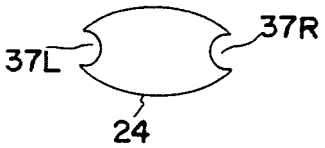
FIG. 2A is a cross section along line 2A—2A in FIG. 2.
Figure 2B:
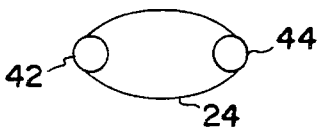
FIG. 2B is a cross section along line 2B—2B in FIG. 2.
Figure 3:
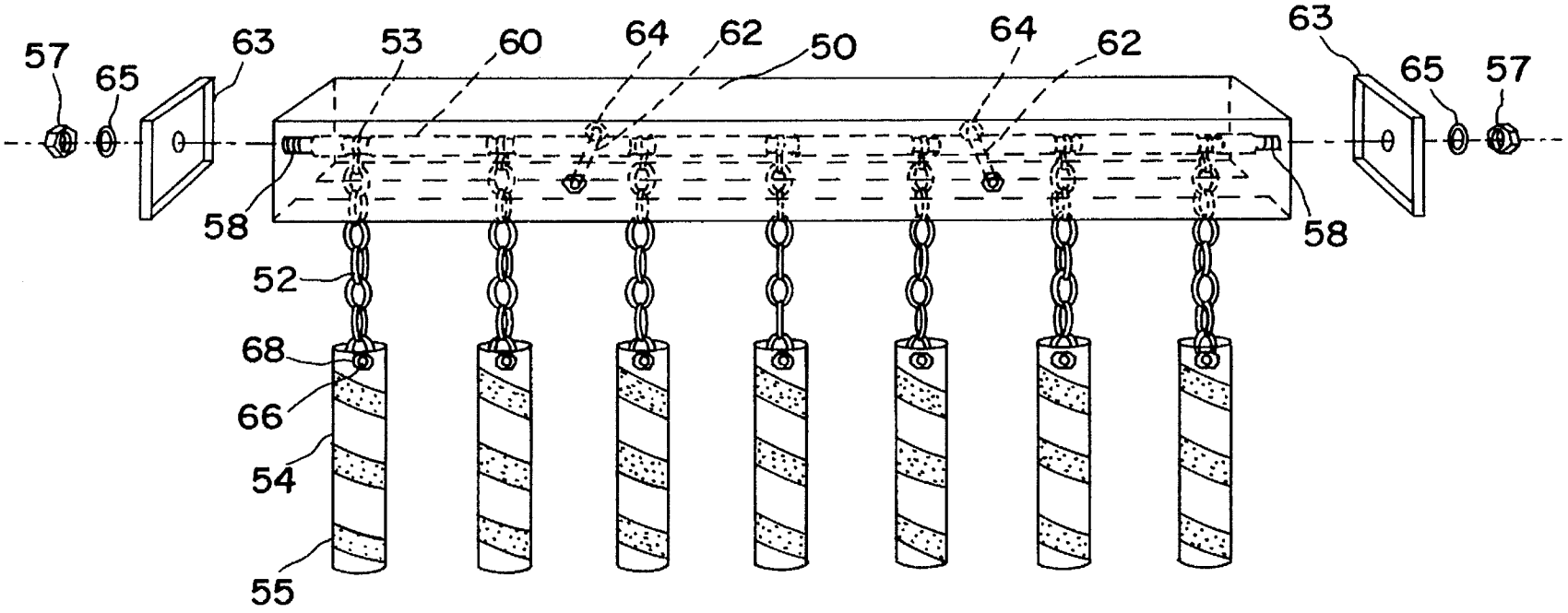
FIG. 3 is an enlarged exploded perspective view of a portion of the embodiment of FIG. 1 showing the chain and cylinder assembly mounted in the chain and rod assembly track housing.

As seen best in FIG. 1, an eye level iconic informational sign 32 is affixed to pole 24 with suitable fastening means. An alphanumeric informational sign 34 is affixed to pole 24 directly above sign 32 also at eye level with suitable fastening means. An overhead alphanumeric sign 48 is attached to upper horizontal arm 44 and lower horizontal arm 42 by suitable fastening means.

As shown in FIGS. 1, 3, 4, 4A and 4B, a chain and cylinder assembly (50, 52 and 54) is attached to upper arm 44 and lower arm 42. The assembly includes a housing track 50 with a support rod 58 mounted to it and carrying depending chains 52 and cylinders 54. As seen in FIGS. 3, 4, 4A, and 4B, the track 50 is a tube having a substantially rectangular cross section and a lower slot 51. The support rod 58 is threaded at both ends and is mounted inside the track 50 with a pair of track end plates 63 which fit into the ends of the track 50, support rod end washers 65 and support rod end nuts 57. Cylindrical chain spacers 60 are mounted on the rod 58 and support S links 53 are attached to rod 58 in between the spacers 60. Supporting chains 52 are attached to the S links 53 and depend from the support rod 58 through the slot 51 in the track 50. The chain spacer bushings 60 prevent the supporting chains 52 from bunching together and preferably provide equidistant spacing between the chains. A hollow cylinder 54 is attached to each chain 52 by means of a supporting bolt 66 and nut 68 which passes diametrically through the cylinder and engages one of the links in the chain 52. Each cylinder 54 is preferably provided with a plurality of reflective stripes 55 which may be painted on the cylinder or applied as adhesive tape to the cylinder. Similarly, the outer face of the track 50 is also provided with a reflective, preferably striped, surface 55*a*.

Figure 4B:
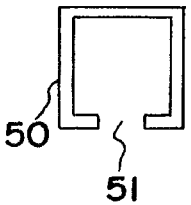
FIG. 4B is an end view of the track housing of FIGS. 4 and 4A.
Figure 4A:
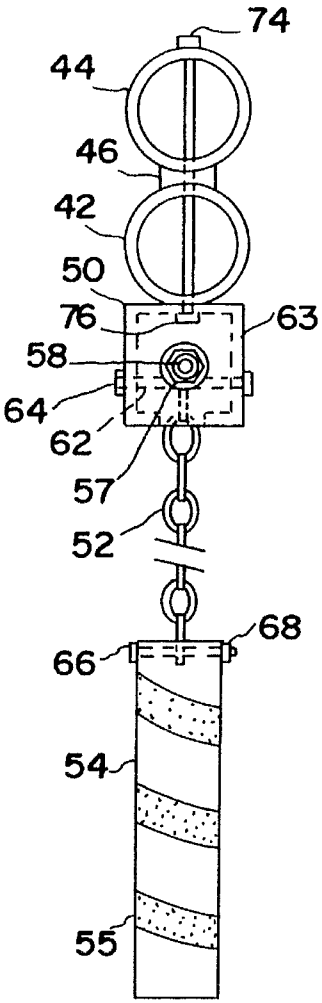
FIG. 4A is an end view of the assembly of FIG. 4.
Figure 4:
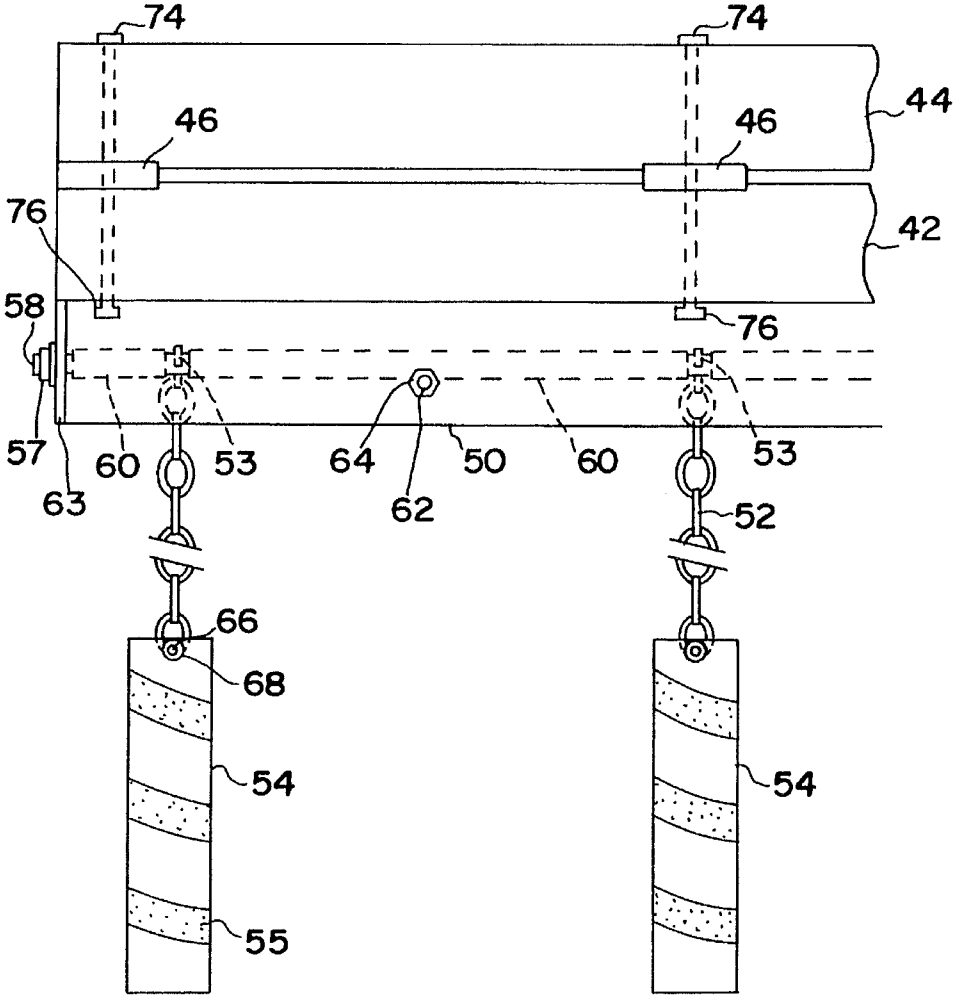
FIG. 4 is an enlarged broken view of a portion of the embodiment of FIG. 1 showing the chain and cylinder assembly attached to the upper and lower horizontal arms.

The track 50 is attached to horizontal arms 42 and 44 with vertical connector bolts 74 and nuts 76 as seen best in FIGS. 4 and 4A. The arms 42, 44 are also preferably provided with spacers 46 mounted between them at the points where the nuts and bolts 74, 76 pass through the arms 42, 44. Additional support for the rod 58 is preferably provided by support bolts 64 and nuts 62 which are mounted in the track 50 below the rod 58 as seen best in FIGS. 3, 4, and 4A.

As seen best in FIG. 1, the total distance from road bed 18 to the bottoms of the cylinders 54 is indicated on the alphanumeric sign 34 mounted on pole 24 and alphanumeric sign 48 mounted on upper horizontal arm 44.

The easy removal of the rod 58, the chains 52 and the cylinders 54 as a unit is accomplished by unscrewing support end nuts 57 and removing washers 65 and end caps 63 and rod and spacer support bolts 62 and nuts 64. Rod 58 is then dropped down through the slot in track 50. This procedure can be carried out when chain and cylinder track housing 50 is affixed to upper horizontal arm 44 and lower horizontal arm 42.

Another feature of the invention is the easy removal of individual cylinder support chains 52 and cylinders 54 from rod 58 while these parts are still mounted in track 50 which is secured to horizontal arms 42 and 44. Their removal is accomplished by lifting the individual chain 52 up and turning S hook 53 to allow chains 52 and cylinders 54 to drop down and away from the track 50 through slot 51. Replacement of individual chains 52 and cylinders 54 is done in the reverse procedure as described above.

Figure 5:
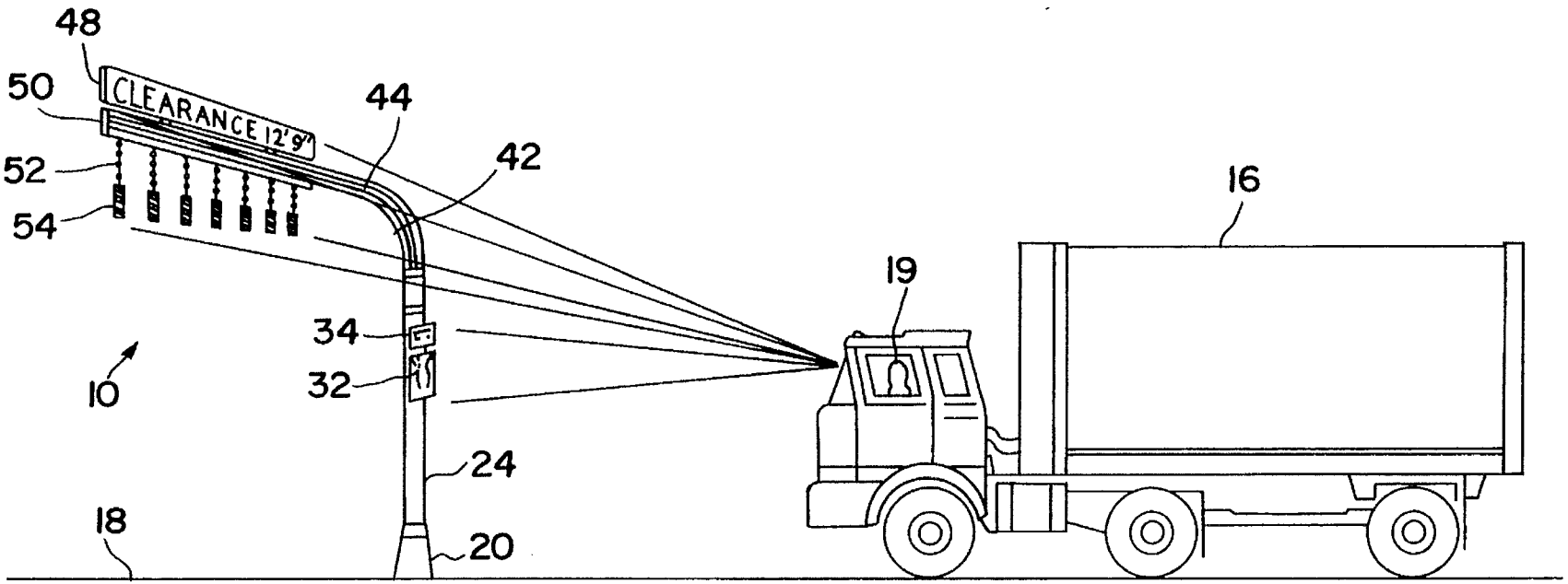
FIG. 5 is a perspective view of a roadway with a tall vehicle approaching the overhead warning system of FIG. 1.

FIG. 5 shows a perspective view of a roadway 18 with a tall vehicle 16 approaching the overhead warning system mounted on pole 24 and upper and lower horizontal arms 44 and 42. The vehicle operator 19 may sight any combination of the overhead warning apparatus 50, 52 and 54, the depending cylinders 54 with reflective stripes 55, the two eye level traffic informational signs 32 and 34, and the overhead alphanumerical sign 48.

FIG. 5 graphically demonstrates the inter-relation of sighting the overhead warning unit 50, 52 and 54 and the informational signs 32, 34 and 48 together or separately. The significance of this presentation offers a truck or bus driver a variety of visual warnings in various combinations of the impending danger of a low clearance overpass on the roadway ahead. If poor visibility makes sighting of this apparatus difficult and a tall vehicle proceeds through the overhead warning unit 50, 52 and 54, an audible sound or loud report of the vehicle's roof contacting the hollow cylinders 54 will be heard. This audible warning provides the added protection to operators of tall vehicles not presently used on roadways today. The flexibility of the depending chains 52 and cylinders 54 will allow the vehicle to pass through the apparatus and then return to their original position.

A significant feature of this overhead warning system is that the vehicle operator 19 is not solely dependent on informational warning signs. The vehicle operator actually encounters a physical simulation of the dangerous overhead hazard on the roadway ahead. Any contact made with the depending chains 52 and cylinders 54 will not cause harmful physical damage to either the vehicle 16 or the warning device 10. If accidental contact is made with the chain and cylinder track housing 50, upper horizontal arm 44 and lower horizontal arm 42 will cause upper and lower shear pins 40 and 41 on pole 24 to sever and allow the cylindrical horizontal arms 42, 44 to rotate freely on support pole 24. Support bands 38 mounted around upper horizontal arm 44 are lower horizontal arm 42 allow the horizontal arms 42 and 44 to rotate on pole 24. Support arms stop bolt 36 prevents the two horizontal arms 42 and 44 from sliding downwards.

Figure 6:
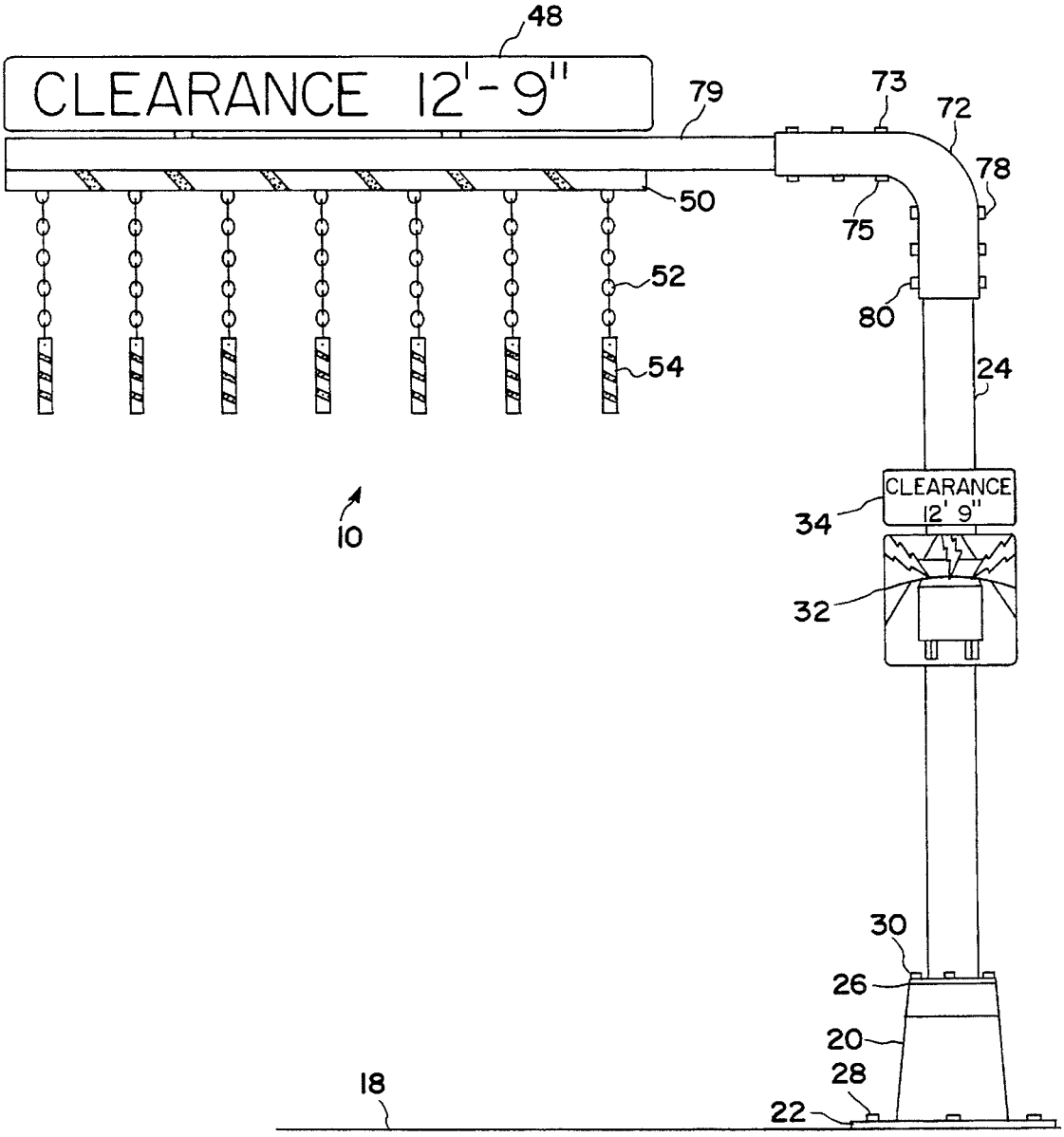
FIG. 6 is a view similar to FIG. 1, but of a second embodiment of the invention.

FIG. 6 shows a second embodiment of the invention with a single horizontal arm 79 firmly attached to vertical pole 24. Bolts 78 and nuts 80 are used to fasten horizontal and vertical pole connector joint 72 to vertical pole 24. Horizontal arm connector bolts 73 and nuts 75 are used to fasten the horizontal arm 79 to horizontal and vertical pole connector joint 72. The chain and cylinder track housing 50, cylinder support chains 52 and metal cylinders 54 are mounted on a horizontal arm 79 in a manner similar to the embodiment described above using nuts and bolts (not shown). This firm connection of pole 24 and arm 79 is an alternate embodiment to the swivel or breakaway feature shown and described above. The overhead warning device 50, 52 and 54 functions exactly as described in the previous embodiment except that the horizontal arm 79 does not swivel or rotate and remains stationery. If arm 79 is impacted it will twist by deforming the joint 72.

Figure 7:
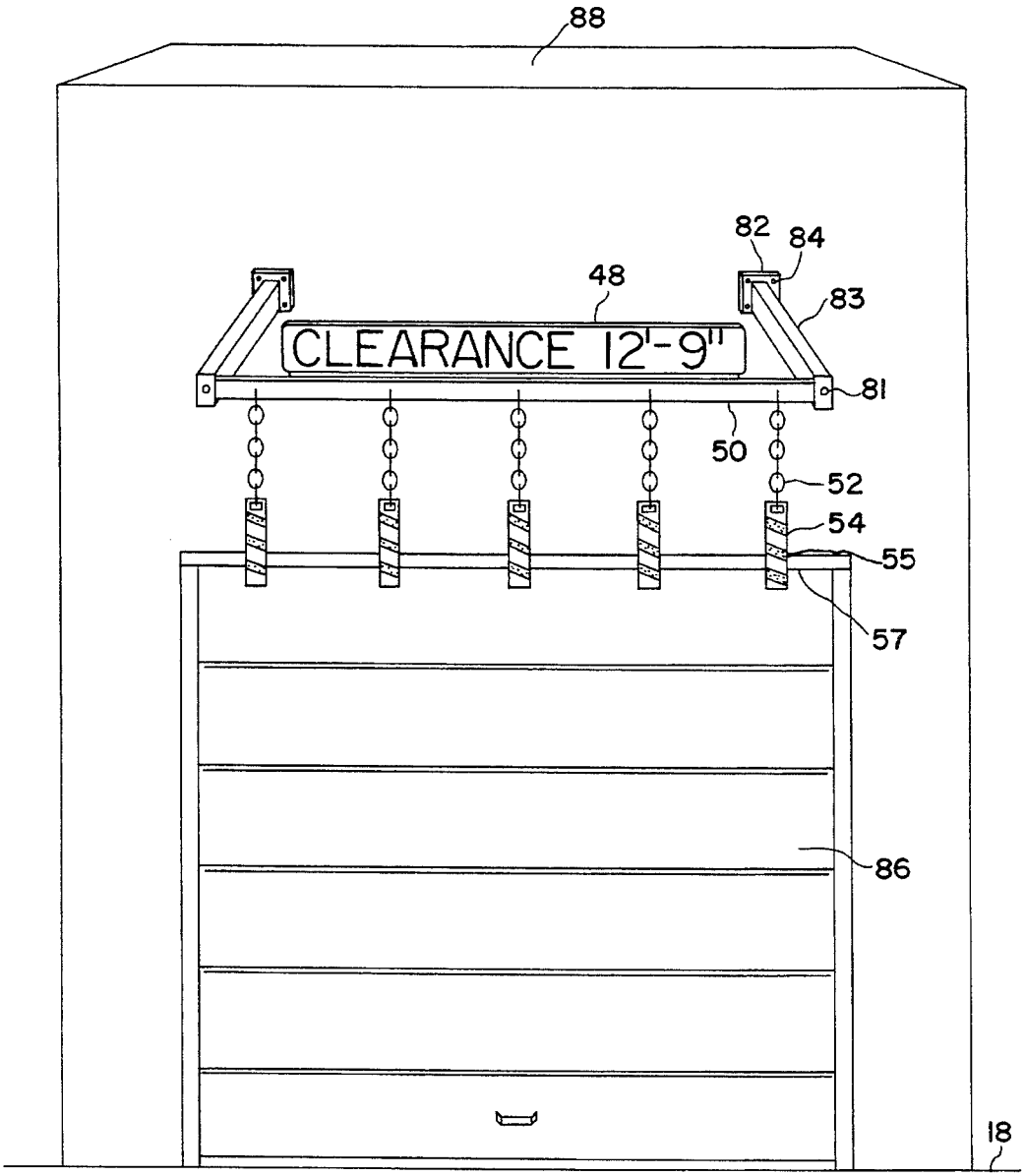
FIG. 7 is a perspective view of a third embodiment of the invention.

FIG. 7 shows a third embodiment of the invention where the chain and rod assembly track 50 with depending chains 52 and cylinders 54 are attached to building 88 above garage door 86. Track 50 is mounted onto building 88 by means of a fastening mount having two track support bars 83, two track support bar mounting flanges 82, two assembly track support bar connector bolts 81 and eight track support flange bolts 84. The exact distance from the base of cylinders 54 to the road bed 18 is the distance indicated on informational sign 48. The support track 50 with depending chains 52 and attached cylinders 54 protrudes out in front of building 88 warning approaching tall vehicles of the maximum clearance height of the garage entrance. The distance above roadway 18 to the base of cylinders 54 is the same or slightly less than the actual clearance of the garage doorway height. Cylinders 54 are highly visible and striped with reflective paint or tape. Individual cylinders 54 can be maintained or replaced as described above.

Figure 8A:
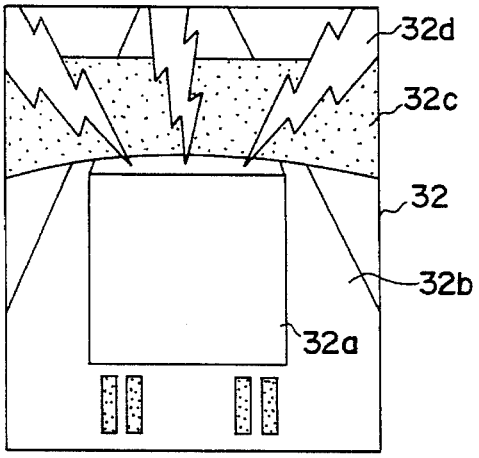
FIGS. 8A through 8D show different embodiments of an iconic warning sign used in the preferred embodiment of the invention.
Figure 8B:
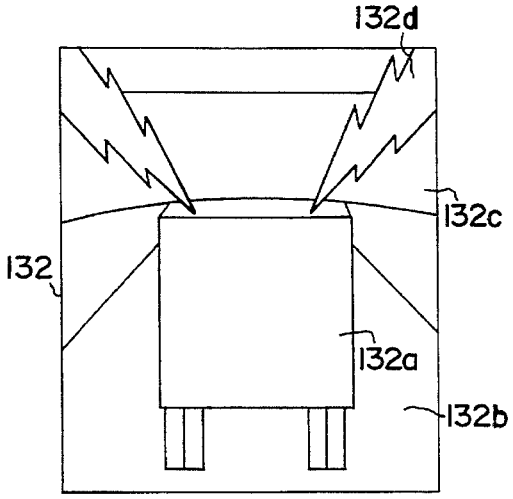
Figure 8C:
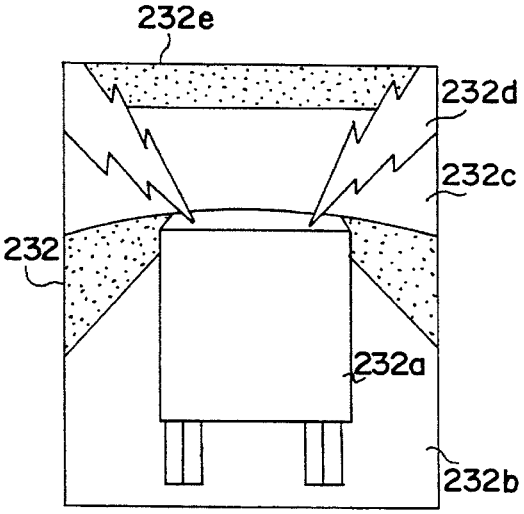
Figure 8D:
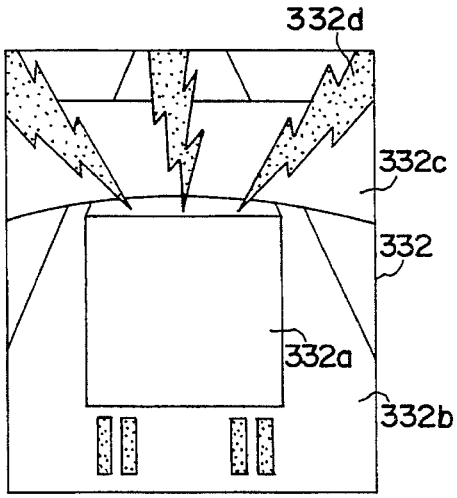

FIGS. 8A through 8D show different embodiments of the iconic informational highway sign 32, 132, 232, and 332 used on the vertical pole 24 as described above. The iconic sign 32 includes a schematic depiction of a tall vehicle 32*a*, 132*a*, 232*a*, 332*a* on a roadway 32*b*, 132*b*, 232*b*, 332*b* passing under a low overpass 32*c* 132*c*, 232*c*, 332*c* with a plurality of lightening bolts 32*d*, 132*d*, 232*d*, 332*d* striking the top of the truck. As shown in FIG. 8A, the truck 32*a* and the overpass 32*c* are filled in with a contrasting color. FIG. 8B shows a similar design without contrasting colors. FIG. 8C shows a design similar to FIG. 8B, but with a contrasting background color 232*e*. FIG. 8D shows a similar design with contrasting color in the lightening bolts 332*d*.

From the foregoing, those skilled in the art will appreciate that the overhead warning system according to the invention will provide a more effective way of preventing or deterring tall motor vehicles from entering restricted roadways or continuing on roadways that have lower overhead clearances than the tall vehicle can fit under. Furthermore, the overhead warning system has the additional advantages that:

1. It provides the operator of a tall vehicle with a highly visible warning of an impending low clearance bridge or obstacle on the roadway ahead;
2. It provides a simulation of the actual low overhead clearance on the roadway ahead;
3. It provides multiple highly visible informational signs plus the highly visible warning device, simultaneously;
4. It reduces pollution and fuel consumption caused by traffic jams resulting from tall vehicles stuck on restricted roadways;
5. It reduces damage to a tall vehicle and its cargo;
6. It reduces damage to roadway overpasses resulting from tall vehicles impacting them;
7. It allows local law enforcement agencies to utilize resources for other problems than extracting tall vehicles from restricted roadways;
8. It deters or prevents tall vehicles from entering or traveling on restricted highways which in turn will save motorists many hours of delays which result from waiting for a tall vehicle to be removed from a restricted roadway;

9. It reduces hours lost by motor carrier operators and reduces down time that tall vehicles incur from being wedged under an overhead crossing or downtime from entering a restricted roadway which requires the closing of the road and the removal of the vehicle.

There have been described and illustrated herein several embodiments of an overhead barrier warning system for tall vehicles. While particular embodiments of the invention have been described, it is not intended that the invention be limited thereto, as it is intended that the invention be as broad in scope as the art will allow and that the specification be read likewise. Thus, while particular materials have been disclosed, it will be appreciated that other materials could be utilized. Also, while specific configurations of the overhead track have been shown, it will be recognized that other types of configurations could be used with similar results obtained. The overhead warning device can easily be electrified providing illumination to light up the essential parts of the invention. It will therefore be appreciated by those skilled in the art that yet other modifications could be made to the provided invention without deviating from its spirit and scope as so claimed.

I claim:

1. An overhead clearance warning system for vehicles, comprising:

horizontal housing track means for supporting one end of each of a plurality of spaced, suspended chains;

warning means attached to the bottom of each of said chains for producing a loud audible warning signal with little or no damage to any vehicle coming into contact with said warning means, said warning means comprising a plurality of cylinders, each of said cylinders being hollow and constructed of a lightweight rigid material capable of producing said loud audible warning signal upon being contacted by a vehicle; and said chains and said cylinders are dimensioned and said horizontal housing track means is located such that bottoms of said cylinders are suspended over a roadway at a vertical distance corresponding to a maximum overhead clearance.

2. An overhead clearance warning system according to claim 1, wherein:

each chain is removably coupled to said horizontal housing track means.

3. An overhead clearance warning system according to claim 1, wherein:

at least some of said cylinders are provided with a reflective surface.

4. An overhead clearance warning system according to claim 3, wherein:

said horizontal housing track means has at least a partially reflective surface.

5. An overhead clearance warning system according to claim 3, wherein:

said horizontal housing track means is coupled to a vertical support member to permit free rotation about a vertical axis of the vertical support member if struck by a tall vehicle.

6. An overhead clearance warning system according to claim 5, further comprising:

at least one alphanumeric warning sign mounted on said horizontal housing track means; and at least one iconic warning sign mounted on the vertical support member.

7. An overhead clearance warning system according to claim 5, wherein:

said horizontal housing track means includes a tubular track enclosing the upper ends of said chains with a lower slot opening through which said chains depend.

8. An overhead clearance warning system according to claim 7, wherein:

said horizontal housing track means further includes a supporting rod extending substantially through said tubular track, said chains being coupled to said rod, and a plurality of chain spacing bushings mounted on said rod between said chains.

9. An overhead clearance warning system according to claim 7, wherein:

each chain is coupled to said rod by an S-hook.

10. An overhead clearance warning system according to claim 9, wherein:

each cylinder is coupled to a respective chain by a diametrical bolt.

11. An overhead clearance warning system according to claim 5, wherein:

said horizontal housing track means is coupled to the vertical support member by a pair of cylindrical arms each of which has a substantially ninety degree bend.

12. An overhead clearance warning system according to claim 11, wherein:

said cylindrical arms are coupled to the vertical support member by at least one shear bolt and at least one band.

13. An overhead clearance warning system according to claim 12, wherein:

a stop bolt is provided in the vertical support member to prevent said arms from sliding vertically relative to the vertical support member.

* * * * *